US008517791B2

(12) United States Patent
Yamada

(10) Patent No.: US 8,517,791 B2
(45) Date of Patent: Aug. 27, 2013

(54) TOY

(75) Inventor: Satoshi Yamada, Tokyo (JP)

(73) Assignee: Spin Master Ltd., Toronto, Ontario (CA)

( * ) Notice: Subject to any disclaimer, the term of this patent is extended or adjusted under 35 U.S.C. 154(b) by 114 days.

(21) Appl. No.: 12/812,506

(22) PCT Filed: Dec. 12, 2008

(86) PCT No.: PCT/JP2008/073127
§ 371 (c)(1),
(2), (4) Date: Jul. 12, 2010

(87) PCT Pub. No.: WO2009/087881
PCT Pub. Date: Jul. 16, 2009

(65) Prior Publication Data

US 2010/0291831 A1 Nov. 18, 2010

(30) Foreign Application Priority Data

Jan. 10, 2008 (JP) ..... 2008-003222

(51) Int. Cl.
*A63H 13/16* (2006.01)

(52) U.S. Cl.
USPC ..... 446/310; 446/129

(58) Field of Classification Search
USPC ..... 446/129, 130, 131, 132, 137, 139, 446/269, 298, 308–311, 376, 390, 486
See application file for complete search history.

(56) References Cited

U.S. PATENT DOCUMENTS 152,250 A * 6/1874 Powers ..... 446/310
1,202,301 A * 10/1916 MacKaye ..... 446/310

(Continued)

FOREIGN PATENT DOCUMENTS

CN 2 649 149 Y 10/2004
DE 85 02 579 U1 4/1985

(Continued)

OTHER PUBLICATIONS

International Search Report dated Mar. 24, 2009, with English translation.

(Continued)

*Primary Examiner* — Gene Kim
*Assistant Examiner* — John E Simms, Jr.
(74) *Attorney, Agent, or Firm* — Scully, Scott, Murphy & Presser, P.C.

(57) ABSTRACT

In order to provide a toy that increases the commercial value of the toy, imparts fresh wonderment and intellectual excitement to the user, and employs a simple structure with a suppressed number of parts, thus making it possible to reduce manufacturing costs and the number of manufacturing processes, the toy (1) comprises: an external component (2), provided with a hole (10) on the lower portion thereof, that maintains a substantially spherical shape and is provided with a housing space formed on the interior thereof; a lower component (3) disposed such that it can move between the inside and the outside of the housing space through the hole (10), and is disposed such that, when inside the housing space, the lower surface thereof aligns with the surface of the external component (2) and the toy (1) forms a substantially spherical shape; a locking means; a magnetic body disposed inside the lower component (3); and an elastic component. When no magnetic force acts between an external magnetic component and the magnetic body, the elastic force of the elastic component is resisted and the lower component (3) is retained inside the housing space by means of the locking means, by means of which the substantially spherical shape is maintained. When a magnetic force has acted between an external magnetic components and the magnetic body, the locking means is released and the lower component (3) rushes out from the hole (10).

7 Claims, 7 Drawing Sheets

(56) References Cited

U.S. PATENT DOCUMENTS

| | | | | |
|---|---|---|---|---|
| 1,615,925 | A * | 2/1927 | Yancey | 446/310 |
| 2,968,121 | A * | 1/1961 | Pearson, Jr. et al. | 446/177 |
| 4,314,422 | A * | 2/1982 | Wexler | 446/269 |
| 5,162,013 | A * | 11/1992 | von Mohr | 446/320 |
| 5,458,525 | A * | 10/1995 | How | 446/310 |
| 5,893,789 | A * | 4/1999 | Wu | 446/129 |
| 6,761,612 | B1 * | 7/2004 | Pencil et al. | 446/310 |
| 7,552,553 | B2 * | 6/2009 | Kelly | 40/124.08 |
| 2003/0047530 | A1 * | 3/2003 | Durbin | 215/207 |
| 2005/0062296 | A1 * | 3/2005 | Lyon | 292/251.5 |
| 2007/0197124 | A1 * | 8/2007 | Sato et al. | 446/129 |

FOREIGN PATENT DOCUMENTS

| | | | |
|---|---|---|---|
| EP | 1 616 609 | A1 | 1/2006 |
| JP | 62-59097 | | 4/1987 |
| JP | 62-194395 | | 12/1987 |
| JP | 64-56295 | | 4/1989 |
| JP | 2007-215898 | A | 8/2007 |

OTHER PUBLICATIONS

Supplementary European Search Report dated Nov. 18, 2011 issued in corresponding European Application No. EP 08 87 0449.9.

* cited by examiner (a)

(b)

TOY

FIELD OF THE INVENTION

The present invention relates to a toy, and in particular relates to a toy that transforms by means of the action of a magnetic force.

DESCRIPTION OF THE RELATED ART

In the past, toys that enable a variety of play effects by means of the action of a magnetic force have been proposed and put to practical use. For example, a toy that transforms from a first shape to a second shape by means of the action of a magnetic force, provided with an external structure, an internal structure housed within the external structure, and a locking means that operates in conjunction with a magnetic body movably disposed inside the toy, has been proposed (see Patent Document 1). In this toy, when no magnetic force acts, the plurality of constituent components that constitute the external structure resist the force of a biasing means, and the spherical-shaped, etc., first shape of the toy is maintained by means of a locking means, and, on the other hand, when a magnetic force has acted, the locked state due to the locking means is released in conjunction with the movement of the magnetic body, causing the bonds between the plurality of constituent elements of the external structure folded into a spherical shape to be released and extend upwardly, and the toy is transformed from the first shape to a character-shaped, etc., second shape.

In the toy according to Patent Document 1, the magnetic-force-expansion-style toy can be made rollable, which can dramatically increase the commercial value of the toy and impart fresh wonderment and intellectual excitement to the user.

Patent Document 1: Japanese Unexamined Patent Application Publication No. 2007-215898

DISCLOSURE OF THE INVENTION

Problems to be Resolved by the Invention

The invention according to Patent Document 1 is such that the toy is rolled, etc., and when it has been brought near a magnet disposed on the travel surface, a magnetic force acts on the toy, and the toy traveling in its rollable first shape instantly stops moving and transforms to a second shape in which a character that was hidden when the toy was in the first shape appears. However, this invention according to Patent Document 1 has a structure in which, during transformation, the upper component, which is constituted of a plurality of components, expands with the lower component as the base, so the structure of the toy is complex and has many parts, and also has a complex assembly procedure for returning the toy from the second shape to the first shape, which is difficult for children to handle. The invention according to Patent Document 1 also only expands horizontally and lacks changes in the vertical direction.

The present invention has taken such problems in the related art into consideration, and aims to provide a rollable magnetic-force-expansion-style toy that achieves a dynamic transformation with larger movement particularly in the vertical direction, with increased commercial value by expanding the target user range to younger children by means of simplifying the procedure for returning the toy to its pre-transformation spherical shape, which imparts fresh wonderment and intellectual excitement to the user and employs a simple structure with a suppressed number of parts, thus making it possible to reduce manufacturing costs and the number of manufacturing processes.

Means for Solving the Problems

In order to solve the problems described above, the toy according to the present invention is a toy that rolls on a travel surface when in a substantially spherical first shape in response to a rolling operation from a user, and transforms to a second shape in locations where external magnetic components are disposed; wherein said toy comprises: an external component, provided with a hole on the lower portion thereof, that maintains a substantially spherical shape when said toy is in either said first shape or said second shape and is provided with a housing space formed on the interior thereof; a lower component disposed such that it can move between the inside and the outside of said housing space through said hole, and is disposed such that, when inside said housing space, the lower surface thereof aligns with the surface of said external component and said toy forms said substantially spherical shape; a locking means; a magnetic body disposed inside said lower component; and an elastic component; and wherein when none of said external magnetic components, which magnetically react with said magnetic body, exists near said magnetic body, the elastic force of said elastic component is resisted and said lower component is retained inside said housing space by means of said locking means, by means of which a rollable external shape is maintained with said external component and said lower component; and wherein said toy is constructed such that, when a magnetic force has acted between one of said external magnetic components and said magnetic body, said locking means is released and said lower component rushes out from said hole; and wherein said toy is constructed such that, when said toy is in said first shape, said lower component is housed in said housing space, and said toy rolls on a travel surface in response to a rolling operation from a user, maintaining said substantially spherical shape; and wherein said toy is constructed such that said toy stops rolling at a location where a magnetic force has acted between said rolling toy and one of said external magnetic components, said locking means is released when said magnetic force acts, said lower component is biased by means of said released elastic force and rushes out from said hole, and said external component is pushed up.

Also, in the toy according to the present invention, said magnetic body is a permanent magnet, and said external magnetic components are steel sheets.

Further, in the toy according to the present invention, said lower component comprises: protruding components; and an elastic component that biases said protruding components such that they protrude from said lower component; and lateral surface openings formed of a size such that said protruding components can protrude outwardly therethrough are formed; and the lateral surfaces of said housing space of said external component are formed as sliding walls; and the elastic force of said elastic component that biases said protruding components is resisted and said protruding components are retained inside said lower component by means of said lateral surface openings of said lower component being obstructed by said sliding walls, which are the lateral surfaces of said housing space; and said toy is constructed such that, when a magnetic force has acted between one of said external magnetic components and said magnetic body, said lateral surface openings of said lower component, which were obstructed by said sliding walls, open by means of said lower component protruding, and said protruding components rush out from said lateral surface openings of said lower component.

Also, in the toy according to the present invention, said locking means is constructed of: a movable component that moves vertically integrally with said magnetic body; turnable components that turn in conjunction with the vertical movement of said movable component; and locking components whose lower ends can elastic-deform outwards; and said movable component is disposed such that it can move vertically inside said lower component near the lower surface thereof, said magnetic body being the lower side; and said turnable components are pivotally arranged inside said lower component above said movable component such that they engage with said movable component; and the upper ends of said locking components are fixed near the upper end of said external component.

Further, in the toy according to the present invention, said toy is constructed such that it can be restored from said second shape to said first shape, and when it has been restored from said second shape to said first shape, a locked state is achieved by means of said locking means and said first shape is maintained again.

Also, in the toy according to the present invention, said external component forms the head of a character, and said lower component forms the lower portion of a character.

Further, the toy according to the present invention may also be a toy that rolls on a travel surface when in a substantially spherical first shape in response to a rolling operation from a user, and transforms to a second shape in locations where external magnetic components are disposed; wherein said toy comprises: an upper component, provided with a hole on the lower portion thereof, that maintains a substantially spherical shell shape when said toy is in either said first shape or said second shape and is provided with a housing space formed on the interior of said shell; a lower component disposed such that it can move between the inside and the outside of said housing space through said hole, and is disposed such that, when inside said housing space, the lower surface thereof aligns with the surface of said upper component and said toy forms said substantially spherical shape; a locking means; a magnetic body disposed inside said lower component; and an elastic component; and wherein when none of said external magnetic components, which magnetically react with said magnetic body, exists near said magnetic body, the elastic force of said elastic component is resisted and said lower component is retained inside said housing space by means of said locking means, and a rollable external shape is maintained; and wherein said toy is constructed such that, when a magnetic force has acted between one of said external magnetic components and said magnetic body, said locking means is released and said lower component rushes out downwards from said hole; and wherein said toy is constructed such that, when said toy is in said first shape, said lower component is housed in said housing space, and said toy rolls on a travel surface in response to a rolling operation from a user, maintaining said substantially spherical shape; and wherein said toy is constructed such that said toy stops rolling at a location where a magnetic force has acted between said rolling toy and one of said external magnetic components, said locking means is released when said magnetic force acts, said lower component is biased by means of said released elastic force and rushes out downwards from said hole, and said upper component is pushed up.

Effect of the Invention

According to the present invention, a rollable magnetic-force-expansion-style toy can be provided that achieves a dynamic transformation with larger movement particularly in the vertical direction, with increased commercial value by expanding the target user range to younger children by means of simplifying the procedure for returning the toy to its pre-transformation spherical shape, which imparts fresh wonderment and intellectual excitement to the user and employs a simple structure with a suppressed number of parts, thus making it possible to reduce manufacturing costs and the number of manufacturing processes.

EXPLANATION OF THE SYMBOLS

| | | | |
|---|---|---|---|
| 1: | Toy | 2: | External component |
| 2a: | Front external component | 2b: | Back external component |
| 3: | Lower component | 3a: | Front lower component |
| 3b: | Back lower component | 4: | Protruding component |
| 5: | Steel sheet | 6: | Curved surface |
| 10: | Hole | 11: | Permanent magnet |
| 12: | Coil spring | 13: | Movable component |
| 13a: | Central circular plate | 13b: | Engagement portion |
| 13c: | Lower circular plate | 13d: | Engagement concave portion |
| 14: | Turnable component | 14a: | Hook |
| 14b: | Through-hole | 14c: | Engagement convex portion |
| 15: | Housing space | | |
| 20: | Coil spring | 21: | Locking component |
| 21a: | Hook | 22: | Sliding wall |

-continued

EXPLANATION OF THE SYMBOLS

| | | | |
|---|---|---|---|
| 23a: | Screw portion | 23b: | Through-hole |
| 24: | Rod | 25: | Cuboid |
| 25a: | Rectangular through-hole | 26: | Rectangular protrusion |
| 27: | Hole edge | 28: | Retainer plate |
| 29: | Flat plate | | |
| 30: | Lateral surface opening | 31: | Circular opening |
| 31a: | Opening edge | 32: | Shaft |
| 33: | Protrusion | 34a: | Screw portion |
| 34b: | Through-hole | 35: | Shaft |
| 36: | Elastic component support plate | 37: | Flat plate |
| 38: | Upper surface opening | | |
| 40: | Torsion coil spring | | |
| 50: | Central space | 51: | Lateral space |
| 52: | Lower space | | |
| 60: | Travel device | 61: | Rotating plate |
| 61a: | Travel surface | 61b: | Hemisphere |
| 61c: | Design | 62: | External wall |
| 63: | Lever | 63a: | Entry hole |
| 63b: | Exit hole | 64: | Mounting pedestal |
| 65: | Cam | 66: | Driven portion |
| 67: | Rack | 68: | First gear |
| 69: | Second gear | | |

BEST MODE FOR CARRYING OUT THE INVENTION

Figure 1:
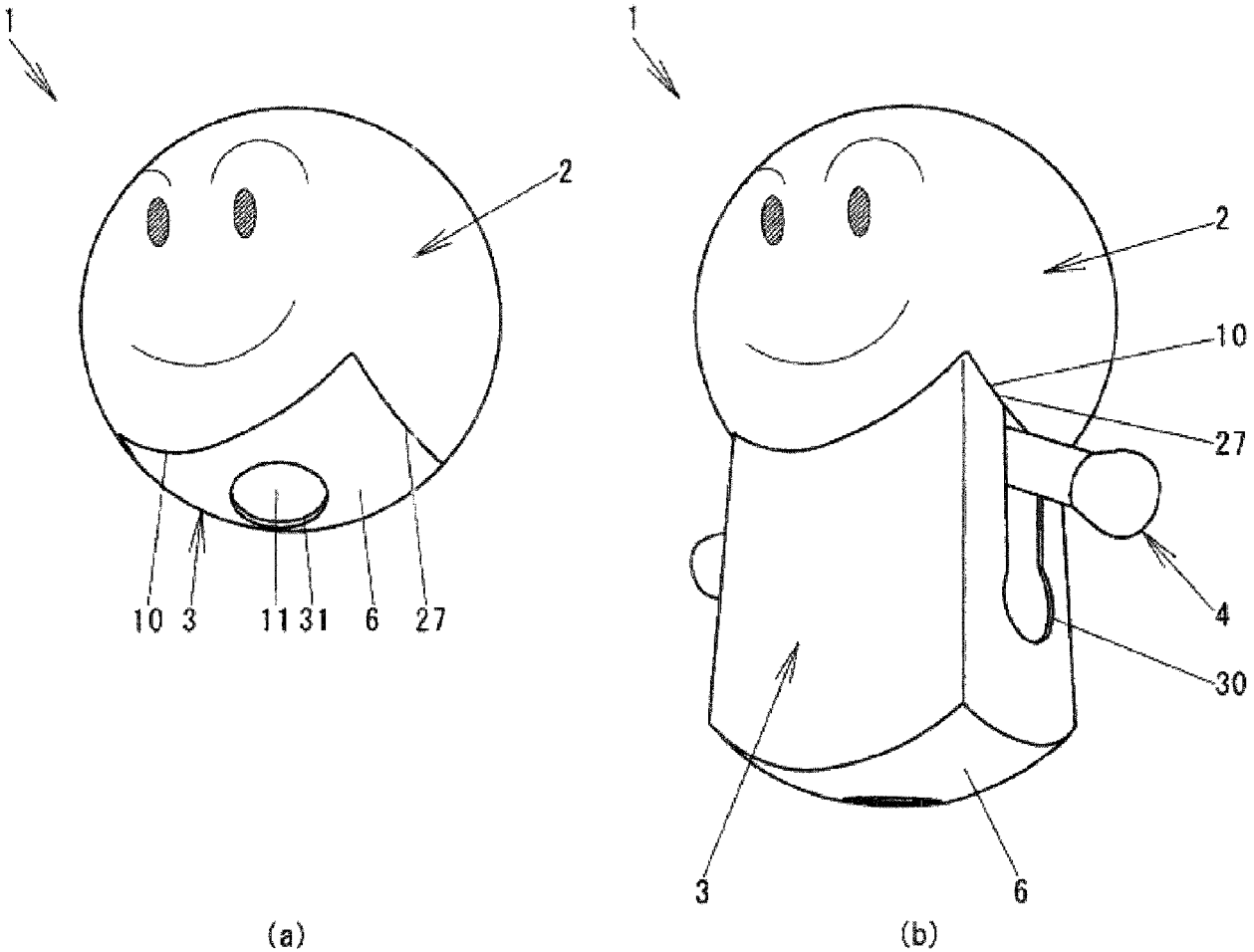
FIG. 1A is a lower perspective view showing the transformation action of a toy in a pre-transformation shape according to an embodiment of the present invention.
FIG. 1B is a lower perspective view showing the transformation action of a toy in a post-transformation shape according to an embodiment of the present invention.

As shown in FIG. 1(*a*), the toy 1 according to the best mode for carrying out the present invention is provided with an external component 2 that forms a shell that maintains a substantially spherical shape when the toy 1 is in either the first shape or the second shape. A space that houses a lower component 3 is formed inside the shell, and a hole 10 is provided in the lower portion of the shell such that the lower component 3 can move between the inside and outside of said space. When in the substantially spherical first shape, in which the lower component 3 is housed within the external component 2, the toy 1 rolls and moves on a travel surface 61*a* of a travel device 60 (see FIG. 7), etc. in response to a rolling operation from the user, in a state in which the substantially spherical shape is maintained. At locations where steel sheets 5 or other external magnetic components are disposed, the lower component 3 rushes out from the hole 10 of the external component 2, and, as shown in FIG. 1(*b*), the toy 1 transforms to a second shape in which the external component 2 is pushed up.

Figure 2:
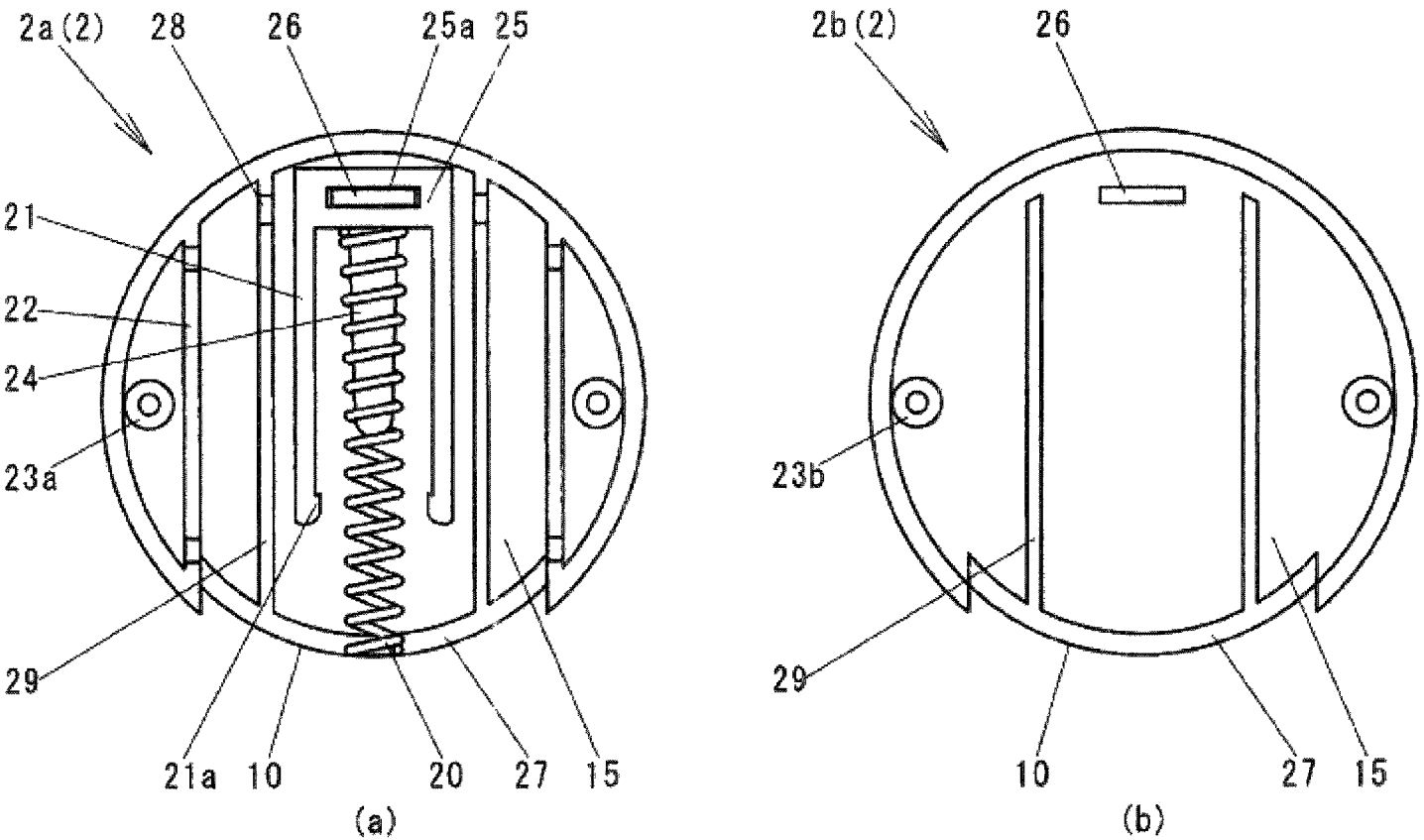
FIG. 2A is a front elevation view of a front external component of a toy according to an embodiment of the present invention.
FIG. 2B is a front elevation view of a back external component of a toy according to an embodiment of the present invention.
Figure 3:
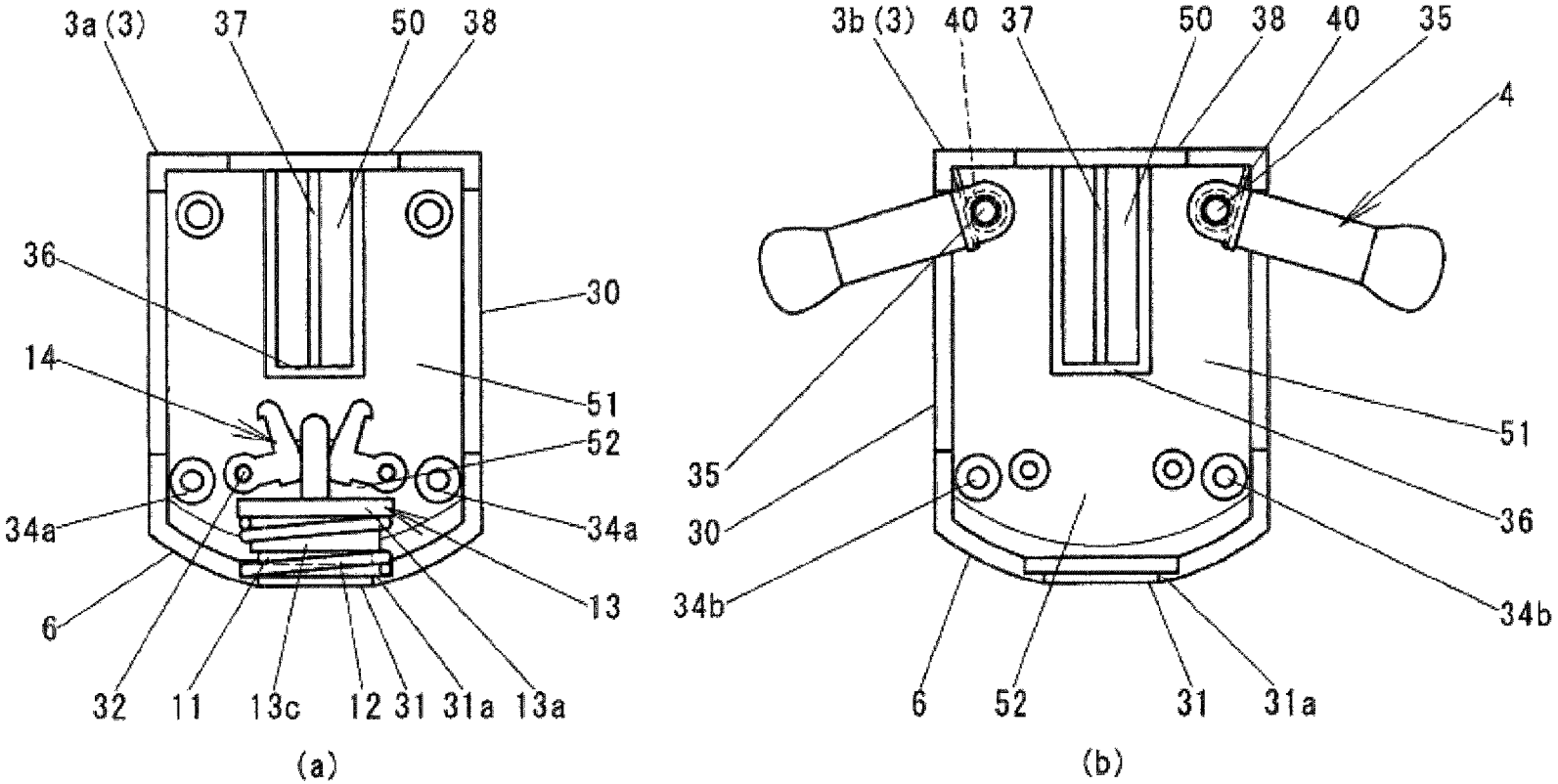
FIG. 3A is a front elevation view of a front lower component of a toy according to an embodiment of the present invention.
FIG. 3B is a front elevation view of a back lower component of a toy according to an embodiment of the present invention.

As shown in FIGS. 1 to 3, the toy 1 comprises the external component 2, the lower component 3, protruding components 4, a locking means, a magnetic body, an elastic body that biases the lower component 3, and elastic bodies that bias the protruding components 4. The external component 2 is provided with a substantially rectangular-shaped hole 10 on the lower portion thereof, maintains a substantially spherical shape when the toy 1 is in either the first shape or the second shape, and is such that the interior thereof forms a substantially cuboid-shaped housing space. The lower component 3 has a substantially cuboid shape and is disposed such that it can slide vertically between the inside and outside of a housing space 15 through the hole 10 along sliding walls 22, which are the lateral surfaces of the housing space 15, and when inside the housing space 15, a curved surface 6, which is the bottom surface, aligns with the surface of the external component 2 such that the toy 1 forms a substantially spherical shape. The protruding components 4 are rod-shaped and pivotally arranged inside the lower component 3 such that they are housed in the lower component 3 by means of the sliding walls 22 when the lower component 3 is inside the housing space 15 of the external component 2. The magnetic body is a discoid permanent magnet 11 disposed inside the lower component 3. The elastic body that biases the lower component 3 is disposed near the center inside the housing space 15, and is a coil spring 20 that biases the external component 2 and the lower component 3 in directions opposite one other. The elastic bodies that bias the protruding components 4 are inserted through shafts 35, which are the centers of rotation of the protruding components 4, and are torsion coil springs 40 that outwardly bias the protruding components 4.

Figure 4:
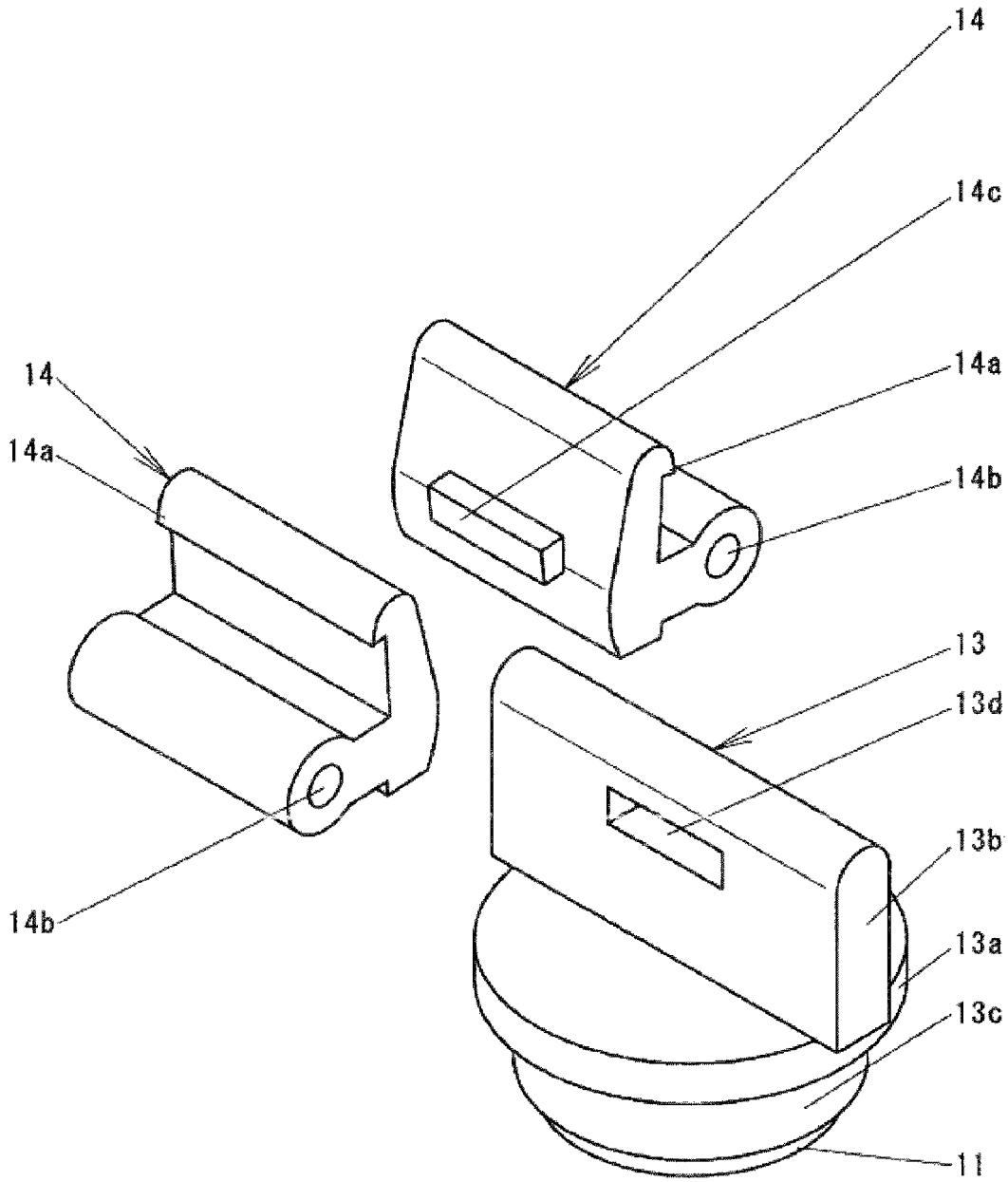
FIG. 4 is a perspective view of the movable components and turnable component of a toy according to an embodiment of the present invention.
Figure 5:
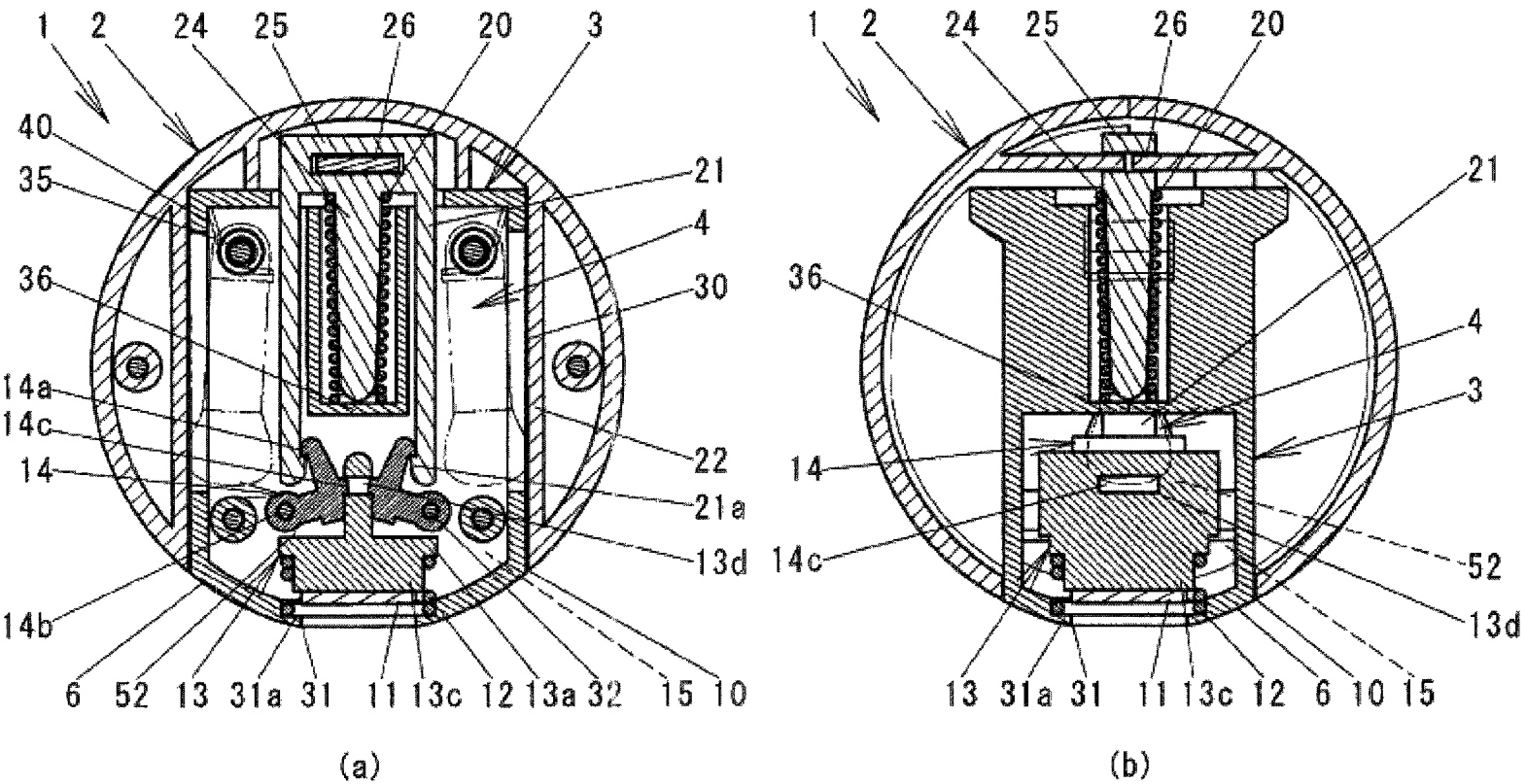
FIG. 5A is a cross-sectional front view of the pre-transformation shape (first shape) of a toy according to an embodiment of the present invention.
FIG. 5B is a cross-sectional side view of the pre-transformation shape (first shape) of a toy according to an embodiment of the present invention.

The locking means is constituted of the movable component 13 and turnable components 14 shown in FIG. 4 and locking components 21 shown in FIG. 5. The movable component 13 moves vertically integrally with the permanent magnet 11, a magnetic body, by means of an elastic force or a magnetic force. The turnable components 14 turn in conjunction with the vertical movement of the movable component 13. The locking components 21 consist of leaf springs whose lower ends can elastic-deform outwards. The movable component 13 is disposed such that it can move vertically inside the lower component 3 near the lower surface thereof, the permanent magnet 11, a magnetic body, being the lower side. The turnable components 14 are pivotally arranged inside the lower component 3 above the movable component 13 such that they engage with the movable component 13. The upper ends of the locking components 21 are fixed near the upper end of the external component 2.

As shown in FIG. 3, the toy 1 has lateral surface openings 30 formed of a size such that the protruding components 4 can protrude outwardly therethrough.

As shown in FIG. 5, the toy 1 is constructed such that when no steel sheet 5, which magnetically reacts with the permanent magnet 11, a magnetic body, exists near the permanent magnet 11 as an external magnetic component, the elastic force of the elastic component consisting of the coil spring 20 that biases the lower component 3 is resisted and the lower component 3 is retained inside the housing space 15 by means of the locking means, and the elastic force of the elastic component consisting of the torsion coil springs 40 that bias the protruding components 4 is resisted, and the protruding components 4 are retained inside the lower component 3 by means of the lateral surface openings 30 of the lower component 3 being obstructed by the sliding walls 22, which are the lateral surfaces of the housing space 15, and the rollable substantially spherical external shape of the toy 1 is maintained with the external component 2 and the lower component 3.

Figure 6:
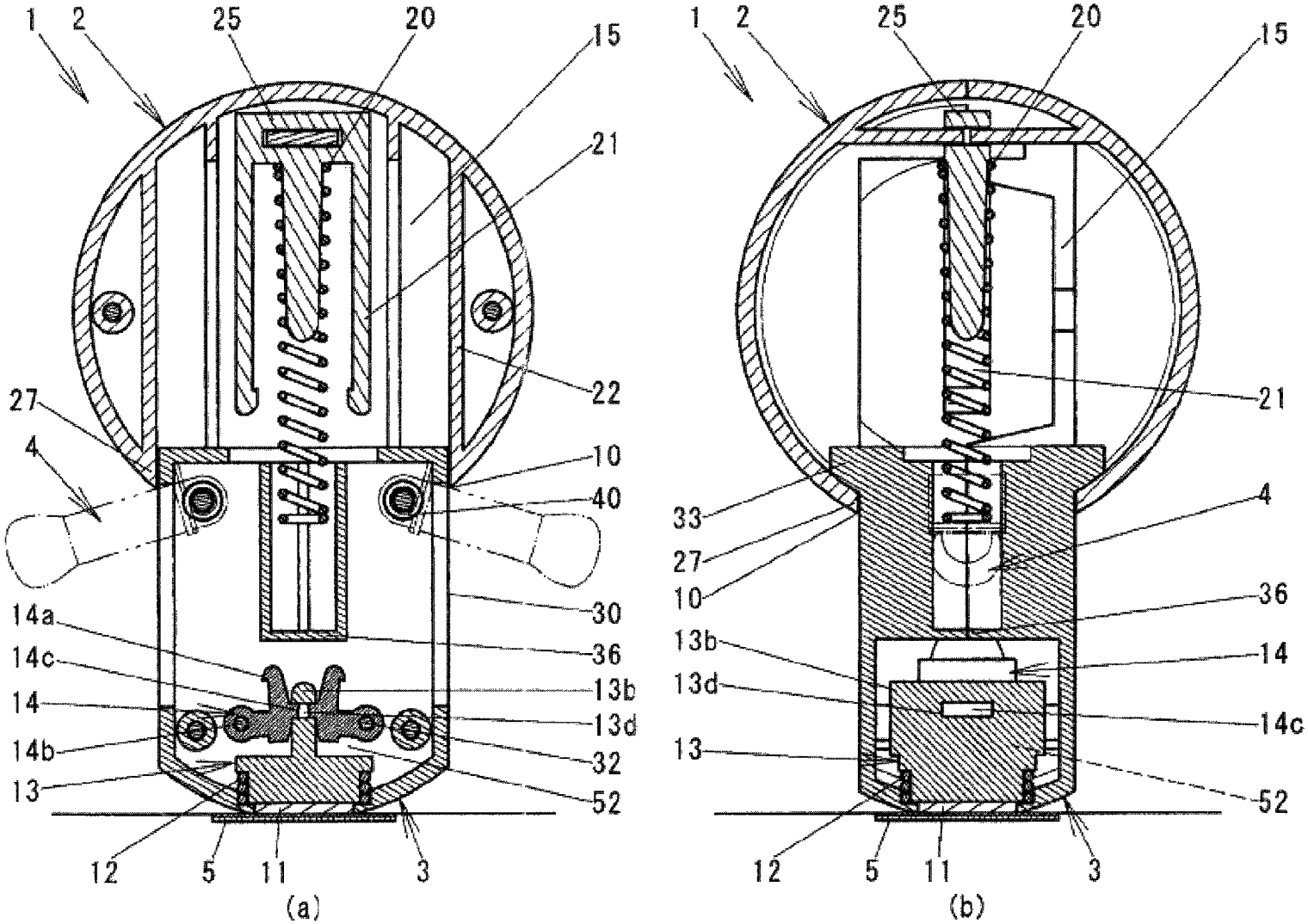
FIG. 6A is a cross-sectional front view of the post-transformation shape (second shape) of a toy according to an embodiment of the present invention.
FIG. 6B is a cross-sectional side view of the post-transformation shape (second shape) of a toy according to an embodiment of the present invention.

As shown in FIG. 6, the toy 1 is also constructed such that when a magnetic force has acted on the permanent magnet 11, a magnetic body, from a steel sheet 5, an external magnetic component, the locked state due to the locking means is released, the lower component 3 slides along the sliding walls 22 and rushes out from the hole 10, and the lateral surface openings 30 of the lower component 3 that were obstructed by the sliding walls 22 are opened by means of the lower component rushing out and the protruding components 4 protrude outwardly from the lateral surface openings 30 of the lower component 3.

The toy 1 is also constructed such that it can be restored from the second shape to the first shape, and when it has been restored from the second shape to the first shape, a locked state is achieved by means of the locking means and the first shape is maintained again.

Figure 7:
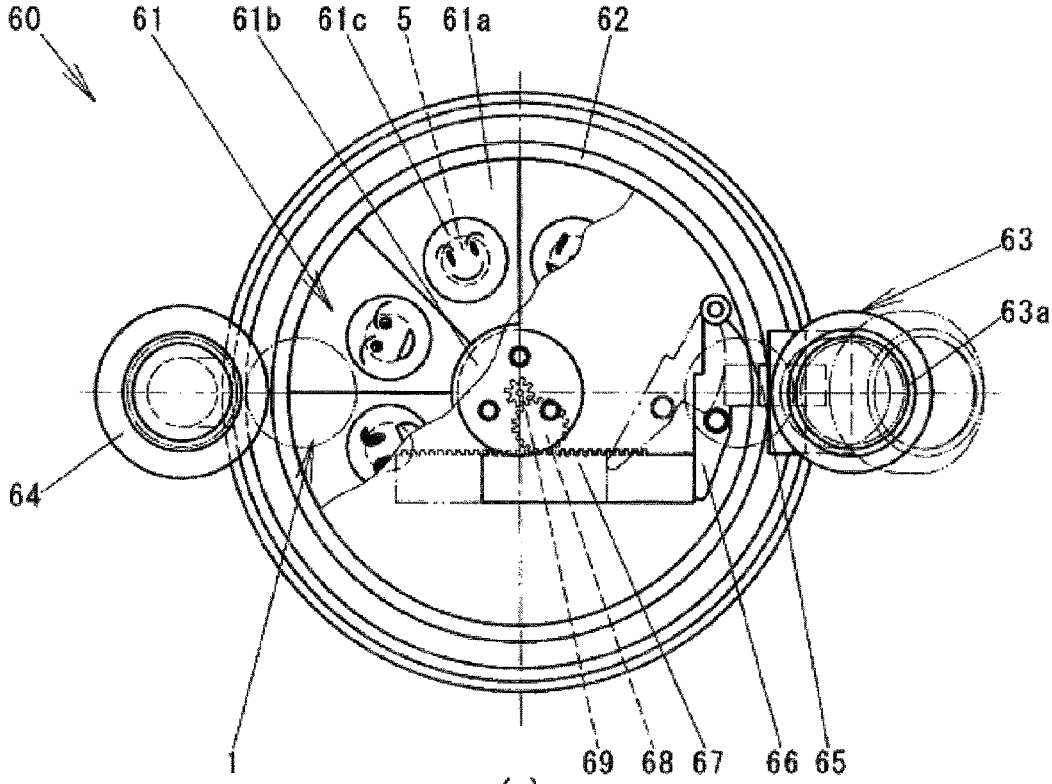
FIG. 7A is a plan view of the travel device of a toy according to an embodiment of the present invention.
FIG. 7B is a front elevation view of the travel device of a toy according to an embodiment of the present invention.
Figure 7:
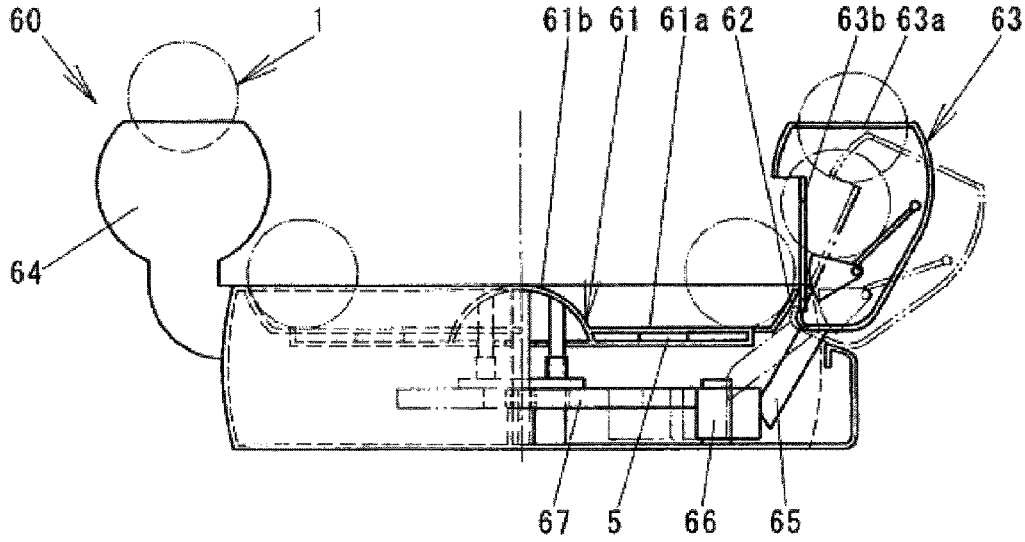

As shown in FIG. 7, the travel surface 61*a* has an annular shape whose periphery is encompassed by an external wall, and rotates with a central axis as the center of rotation. Steel sheets 5, external magnetic components, are disposed in a plurality of specific locations under the surface of the travel surface 61*a* in the travel device 60 provided with this travel surface 61*a*. When the toy 1 rolls and moves in the first shape, the travel surface 61*a* slowly rotates. Then, when the toy 1 in the first shape passes directly over a steel sheet 5 disposed under the surface of the travel surface 61*a*, the permanent magnet 11, a magnetic body, disposed in the curved surface 6 of the lower component 3 of the rolling toy 1 becomes positioned at the lower surface and the steel sheet 5 and the permanent magnet 11 come close to one another, causing a magnetic force to act between the steel sheet 5 and the permanent magnet 11, whereupon the rolling movement of the toy 1 stops, the locking means is released, and the toy 1 transforms to the second shape.

Embodiment

An embodiment of the present invention will now be described in detail with reference to the drawings. As shown in FIGS. 1(*a*) and (*b*), the toy 1 according to the present invention is such that, when in the substantially spherical first shape, the toy 1 rolls and moves in response to a rolling operation from the user, and, at locations where external magnetic components are disposed, the toy 1 transforms to a second shape in which a lower component 3 protrudes from the substantially spherical-shaped external component 2. The toy 1 is constructed of the external component 2, which maintains a substantially spherical shell shape when the toy 1 is in either the first shape or the second shape, a substantially cuboid-shaped lower component 3, and rod-shaped protruding components 4. The external component 2 is provided with a substantially rectangular-shaped hole 10 on the lower portion thereof, and a substantially cuboid-shaped housing space is formed inside the shell. The lower component 3 is disposed such that it can slide vertically between the inside and outside of the housing space through the hole 10. The lower component 3 is also disposed such that, when inside the housing space, a curved surface 6, which is the bottom surface, aligns with the surface of the external component 2 such that the toy 1 forms a substantially spherical shape (that is, the surface of the toy 1 forms a substantially spherical shape). The protruding components 4 are arranged such that they can protrude outwardly from the left and right sides of the lower component 3. In this toy 1, the external component 2 represents the head of a character, the lower component 3 represents a torso, the lower portion of the character, and the protruding components 4 represent the arms of the character. That is, the external component 2 is a shell that houses the lower component 3, and, when the toy 1 is in the second shape, the external component 2 is disposed above the lower component 3 and is an upper component that represents the head of the character. It is preferred that the components 2, 3, and 4 be formed of a non-magnetic material, such as plastic. By taking advantage of the fact that the external component 2 has a substantially spherical shape and drawing the face of a popular character thereon, it can be enjoyed by young children as well.

As shown in FIGS. 2(*a*) and (*b*), the external component 2 is formed of a front external component 2*a* and a back external component 2*b* halved at the center plane in the anteroposterior width direction of the external component 2 such that they form symmetrical shapes opposing one another as an integrated unit. In the present embodiment, cylindrical components are provided near the left and right ends of the front external component 2*a* shown in FIG. 2(*a*) and the back external component 2*b* shown in FIG. 2(*b*) such that they oppose one another. The cylindrical components of the front external component 2*a* are screw portions 23*a* with a screw groove formed on the internal surface thereof. The cylindrical components of the back external component 2*b* are through-holes 23*b* with a hole with a diameter slightly larger than the diameter of the screws formed therein. By inserting screws into the through-holes 23*b* from the back of the back external component 2*b* and screwing them into the screw portions 23*a*, the external component 2 is formed by making the front external component 2*a* and the back external component 2*b* an integrated unit.

The interior of the external component 2 is provided with a coil spring 20, which is an elastic component that biases the lower component 3 to protrude from the external component 2, locking components 21, which are a locking means that resist the elastic force of the coil spring 20 and lock the lower component 3 and the external component 2 together, sliding walls 22, which prevent the protruding components 4 from protruding from the lower component 3 and allow the lower component 3 to slide along the housing space of the external component 2, etc.

The coil spring 20 is engaged with an extending rod 24 that depends downwardly to near the center of the external component 2 from the bottom surface of a cuboid 25 fixed near the upper end of the external component 2. The upper end and region near the upper end of the coil spring 20 are adhesively fixed to the cuboid 25 and the rod 24. By means of this, the coil spring 20 is vertically disposed in the center of the external component 2. The coil spring 20 is inserted from an opening in the upper surface of the lower component 3, and the lower end thereof is supported by an elastic component support plate 36 of the lower component 3, which will be described hereinafter. By means of this, the external component 2 and the lower component 3 are elastically biased in directions opposite one other.

As a locking means, the locking components 21 are flat plate components extending from the left and right ends of the cuboid 25 lateral to the left and right of the coil spring 20 such that they are parallel to the rod 24 (that is, such that they depend downwardly from the left and right ends of the cuboid 25). Hooks 21*a* are formed on the inside lower ends of the locking components 21. The cuboid-shaped cuboid 25 is positioned above the locking components 21 and the rod 24, is provided with a rectangular through-hole 25*a*, which is a rectangular-shaped through-hole, and has a cross-sectional rectangular shape. A rectangular protrusion 26, formed protruding in the anteroposterior direction from the internal wall near the upper end of the front external component 2*a* and the back external component 2*b*, is engaged with the rectangular through-hole 25*a*. By means of this, the locking components 21 and the coil spring 20 are disposed in prescribed locations inside the external component 2. In the present embodiment, because the rectangular protrusion 26 of the front external component 2*a* is inserted into and adhesively fixed to the rectangular through-hole 25*a* beforehand, it is integrated with the front external component 2*a*. Consequently, when the front external component 2*a* and the back external component 2*b* are opposed to face one other and connected together, the rectangular protrusion 26 of the back external component 2*b* can be easily fitted into the rectangular through-hole 25*a* of the cuboid 25, which has become integrated with the front external component 2*a*.

The sliding walls 22 are disposed on the outside of the locking components 21 such that their respective planar surfaces oppose one another. The internal sides of the sliding walls 22 house the lower component 3 as a housing space 15. The sliding walls 22 are also in contact with a portion of the lateral external surfaces of the protruding components 4, which turn in conjunction with the vertical movement of the lower component 3, limit the turning movement of the protruding components 4, and allow the lower component 3 to move such that it can slide therealong.

Flat plates 29 are provided between the cuboid 25 and the sliding walls 22 on the internal walls of the front external component 2*a* and the back external component 2*b* such that their respective planar surfaces oppose one another. These flat plates 29 are linked from around the anteroposterior of a hole edge 27, the edge of the hole 10. Retainer plates 28 perpendicularly extend from near the upper end of the flat plates 29. When the lower component 3 is housed in the external component 2, these retainer plates 28 are in contact with the upper end surface of the lower component 3, thereby limiting the vertical movement range of the lower component 3.

The housing space 15, which is a substantially cuboid-shaped space that can house the lower component 3, is formed inside the shell of the external component 2 by means of the flat plates 29, sliding walls 22, retainer plates 28, and hole edge 27.

By means of this, the lower component 3 is restricted from moving in the anteroposterior direction by means of the internal edge surfaces of the flat plates 29 and from moving laterally by means of the sliding walls 22, and can move sliding vertically between the inside and outside of the housing space 15, which is a substantially cuboid-shaped space. The locking components 21 and the coil spring 20 can also be inserted from the upper surface opening of the lower component 3, which will be described hereinafter.

In the present embodiment, the sliding walls 22 and the retainer plates 28 are provided only on the front external component 2*a* so that, when the front external component 2*a* and the back external component 2*b* are connected together to form the external component 2, they protrude to the back external component 2*b* side to form substantially symmetrical shapes with respect to the center plane in the anteroposterior width direction of the external component 2.

Engageable levels can also be provided on the connecting surfaces of the circumferential edges of the front external component 2*a* and the back external component 2*b*, as well as the screw portions 23*a* and through-holes 23*b*, so that the front external component 2*a* and the back external component 2*b* can be connected together reliably and easily.

As shown in FIGS. 3(*a*) and (*b*), the lower component 3 has a substantially cuboid shape, and consists of a box-shaped front lower component 3*a* and back lower component 3*b* halved in the anteroposterior width direction along the anteroposterior direction of the lower component 3 so that they form substantially symmetrical shapes. The lower component 3 is formed by means of opposing the front lower component 3*a* and the back lower component 3*b* to face one another and connecting them together, then inserting screws from the back of the back lower component 3*b* and screwing them in, making the front lower component 3*a* and the back lower component 3*b* an integrated unit. Screw portions 34*a* and through-holes 34*b*, which are screw-in portions, are formed in a similar fashion to the screw portions 23*a* and the through-holes 23*b* of the front external component 2*a* and the back external component 2*b*, and are disposed near the left and right lower ends of the front lower component 3*a* shown in FIG. 3(*a*) and the back lower component 3*b* shown in FIG. 3(*b*).

Engageable levels can also be provided on the connecting surfaces of the external edges of the front lower component 3*a* and the back lower component 3*b*, as well as the circumferential edges of the screw portions 34*a* and the through-holes 34*b*, in a similar fashion to the external component 2, so that the front lower component 3*a* and the back lower component 3*b* can be connected together reliably and easily.

A substantially cuboid-shaped space is formed in the lower component 3 when the front lower component 3*a* and the back lower component 3*b* are made an integrated unit. This space is constructed of a substantially cuboid-shaped central space 50 in which the coil spring 20 attached to the external component 2 is disposed, a substantially cuboid-shaped lateral space 51 in which the protruding components 4 are housed, and a lower space 52 in which the movable component 13, which is movable by means of a magnetic force and an elastic force caused by the permanent magnet 11 and a coil spring 12, etc., which will be described hereinafter, are housed.

The central space 50 is a space that houses the coil spring 20 attached to the external component 2, and is positioned centrally above the lower component 3. The upper surface opening 38 formed in the upper surface plate of the lower component 3 so that the coil spring 20 can be inserted from above is the upper surface of the central space 50. The front internal surface and back internal surface of the lower component 3 and four flat plates mounted vertically on these internal surfaces are the lateral surfaces of the central space 50. An elastic component support plate 36, which is a flat plate installed on the lower end of the four flat plates perpendicular thereto is the lower surface of the central space 50.

The horizontal width of the central space 50 is formed to be slightly larger than the external diameter of the coil spring 20. The vertical length of the central space 50 is formed to a length such that the coil spring 20 can be housed therein when compressed. The elastic component support plate 36, which is the lower surface of the central space 50, supports the lower end of the coil spring 20. An adjustment plate can also be adhered, etc. above the elastic support plate 36, and the length of the coil spring 20 when compressed adjusted. In such case, it is preferred that the adjustment plate be installed such that it protrudes into the opposing lower component in either the back lower component 3*b* or the front lower component 3*a* so that the lower components 3*a* and 3*b* connect easily.

In the present embodiment, flat plates 37 are mounted vertically on the anteroposterior internal surfaces of the lower component 3 in the center in the horizontal width direction of the lower component 3. By means of this, the horizontal width of the central space 50 can be adjusted to be slightly larger than the external diameter of the coil spring 20, so the coil spring 20 can be smoothly guided to the elastic component support plate 36 and the coil spring 20 can be prevented from moving in the anteroposterior direction when in a housed state.

The lateral space 51 is a space that houses the protruding components 4 and the locking components 21, and is positioned to the left and right of the lower component 3. This lateral space 51 is formed in a substantially cuboid shape by means of the flat plates that form the lateral surfaces and anteroposterior surfaces of the lower component 3, and the four flat plates that form the left and right surfaces of the central space 50. The upper surface opening 38 formed in the upper surface plate of the lower component 3 so that the locking components 21 can be inserted from above is part of the upper surface of the lateral space 51. The lateral housing space 51 is formed at a size that can house the protruding components 4 and the locking components 21. Lateral surface openings 30, whose shape matches that of the protruding components 4, are formed in the lateral surface plates of the lower component 3, which are the lateral surfaces of the lateral space 51. By means of this, the protruding components 4 disposed inside the lateral space 51 can rotate outwardly to the left and right with shafts 35 mounted vertically near the left and right upper end of the lower component 3 as the centers of rotation.

The shafts 35 are mounted vertically on the back lower component 3*b* so that they protrude to the front lower component 3*a* from the interior of the back lower component 3*b*. When the front lower component 3*a* and the back lower component 3*b* are connected together, these shafts 35 are inserted into the cylindrical concave portions of the front lower component 3*a*, provided in positions opposing the shafts 35. Through-holes are formed on one end of the rod-shaped protruding components 4, and torsion coil springs 40, which are elastic components, are inserted into the shafts 35 so that the protruding components 4 can be biased to protrude outwardly to the left and right from the lower component 3.

The lower space 52 is positioned in the lower portion of the lower component 3. It is the portion of space excluding the central space 50 and the lateral space 51, and is formed as a space wherein the movable component 13 and the turnable components 14, which will be described hereinafter, can move or turn. A circular opening 31 with a diameter substantially equivalent to the external diameter of the discoid permanent magnet 11 is provided on the curved-surface-shaped lower surface plate of the lower component 3, which is the lower surface of the lower space 52. The permanent magnet 11 is disposed above the circular opening 31 such that it can move vertically with the movable component 13. Consequently, when the permanent magnet 11 is attracted by an external magnetic component, such as a steel sheet, that magnetically reacts with the permanent magnet 11, the permanent magnet 11 is pulled towards the external magnetic component and forms a portion of the lower surface plate of the lower component 3.

An opening edge 31*a* that forms an annular upper opening with a diameter larger than that of the circular opening 31 is provided near the edge of the circular opening 31, forming levels. A coil spring 12 is housed in the lower space 52 such that the lower end of the coil spring 12 is in contact with the upper surface of the opening edge 31*a*. That is, the lower end of the coil spring 12 is in contact with the opening edge 31*a* and the upper end of the coil spring 12 is in contact with the central circular plate of the movable component 13, which will be described hereinafter, and the movable component 13 can be biased upwardly by means of the action of an elastic force on the movable component 13.

The lower surface of the lower component 13 is formed as a curved surface 6, which forms a portion of the substantially spherical external shape (that is, a portion of the substantially spherical surface). As shown in FIG. 1(*a*), the toy 1 is constructed such that, when the lower component 3 is inside the housing space 15 of the external component 2, the curved surface 6 aligns with the surface of the external component 2 such that the toy 1 forms the first shape, which is a substantially spherical shape.

As shown in FIG. 3, the lower component 3 is provided with the movable component 13 and the turnable components 14 as a locking means that is engageable with the locking components 21 of the external component 2, the permanent magnet 11, and the coil spring 12. The turnable components 14 are pivotally supported by shafts 32, which are the centers of rotation thereof. The movable component 13 engages with the turnable components 14 and transmits force thereto. The discoid permanent magnet 11, a magnetic body, and the coil spring 12, an elastic component, control the vertical movement of the movable component 13.

The turnable components 14 are disposed to the left and right in the upper portion of the lower space 52. The movable component 13 is disposed in the center in the lower portion of the lower space 52. In the present embodiment, the turnable components 14 and the movable component 13 are disposed beforehand in the front lower component 3*a*. As shown in FIG. 4, the turnable components 14 have a substantially cross-sectional L-shape, and through-holes 14*b* are provided near one end thereof, disposed on the outside on the left and right sides. Hooks 14*a* are provided on the left and right external sides on the other end of the turnable components 14. Cuboid-shaped engagement convex portions 14*c* are provided near the bottom of the turnable components 14 on the internal surfaces on the left and right sides. Shafts 32 that are mounted vertically on the front internal surface of the front lower component 3*a* are inserted into the through-holes 14*b* of the turnable components 14. By means of this, the turnable components 14 are housed in the lower component 3 such that they can turn with the shafts 32 as the centers of rotation. When the shafts 32 connect the front lower component 3*a* and the back lower component 3*b* together, they are inserted into cylindrical concave portions mounted vertically in locations opposing the shafts 32.

The movable component 13 consists of a discoid central circular plate 13*a* in the center, a lower circular plate 13*c* disposed below the central circular plate 13*a*, and an engagement portion 13*b*, which is a flat plate mounted vertically from the upper surface of the central circular plate 13*a*. The lower circular plate 13*c* is formed thickly, with a diameter smaller than that of the central circular disc 13*a*. The lower circular disc 13*c* is disposed on the same central axis as the central circular plate 13*a*, forming levels at the connection portion. The engagement portion 13*b* is provided with an engagement concave portion 13*d* that the engagement convex portions 14*c* of the turnable components 14 can engage with from the outside on the left and right sides. This engagement concave portion 13*d* is formed as a rectangular-shaped through-hole slightly larger than the size of the cross-sectional shape of the engagement convex portions 14*c*.

As shown in FIG. 3(*a*), the discoid permanent magnet 11 is adhered to the lower surface of the lower circular plate 13*c*, making an integrated unit with the movable component 13. By means of this, if a magnetic force acts on the permanent magnet 11, the movable component 13 moves integrally with the permanent magnet 11. The coil spring 12, which has an internal diameter slightly shorter than the external diameter of the lower circular plate 13*c*, is attached to the periphery of the lower circular plate 13*c*, in a slightly elastically deformed state around the circumference. The coil spring 12 is disposed such that the upper end thereof is in contact with the lower surface of the central circular plate 13 and can transmit elastic force from below to the movable component 13.

The movable component 13 and the turnable components 14 are housed in the lower space 52 in a state in which the engagement convex portions 14*c* of the turnable components 14 are engaged with the engagement concave portion 13*d*. When the movable component 13 moves upwards, the lower surface of the engagement concave portion 13*d* of the engagement portion 13*b* and the lower surfaces of the engagement convex portions 14*c* of the turnable components 14 come into contact, by means of which force is transmitted from the movable component 13 to the turnable components 14 and the turnable components 14 turn, with the shafts 32 as the centers of rotation. When the movable component 13 moves downwards, the upper surface of the engagement concave portion 13*d* and the upper surfaces of the engagement convex portions 13*c* come into contact, and the turnable components 14 turn in the opposite direction.

The transformation operation of the toy 1 according to the present embodiment will now be described with reference to FIG. 1, FIG. 5, and FIG. 6. FIG. 5 is a view showing the pre-transformation shape (first shape) of the toy 1. FIG. 6 is a view showing the post-transformation shape (second shape) of the toy 1. FIG. 5(*a*) and FIG. 6(*a*) are cross-sectional views of the center in the anteroposterior width direction. FIG. 5(*b*) and FIG. 6(*b*) are cross-sectional views of the center in the horizontal width direction.

When no steel sheet or other external magnetic component exists near the permanent magnet 11 disposed in the curved surface 6 of the lower component 3 of the toy 1, the permanent magnet 11 does not move due to a magnetic force. By means of this, the toy 1 is maintained in a state in which the movable component 13 is pressed and moved upwards by means of the elastic force of the coil spring 12 disposed in the lower space 52 of the lower component 3. In this state, as shown in FIGS. 5(*a*) and (*b*), the hooks 14*a* of the movable component 14 disposed in the lower space 52 are locked by means of the hooks 21*a* of the locking components 21 fixed to the external component 2. Consequently, at this time, as shown in FIG. 1(*a*) and FIGS. 5(*a*) and (*b*), the toy 1 is maintained in the rollable substantially spherical-shaped first shape, in which the lower component 3 is housed in the housing space 15 of the external component 2.

In such a state, as shown in FIGS. 5(*a*) and (*b*), the lower end of the coil spring 20, whose upper end and region near the upper end are attached to the rod 24 extending from the center of the cuboid 25 that is engaged and fixed by means of the rectangular protrusion 26 of the external component 2, is supported by the elastic component support plate 36 of the lower component 3, and is housed in a state in which it is compressed in the vertical direction. As a result, in this state, the coil spring 20 presses the external component 2 upwards through the rod 24 and the cuboid 25, and presses the lower component 3 downwards through the elastic component support plate 36.

However, because the hooks 21*a* of the locking components 21 extending from the cuboid 25 and the hooks 14*a* of the turnable components 14, which are pivotally arranged with the shafts 32 of the lower component 3 as the centers of rotation, are engaged, the elastic force of the coil spring 20 is resisted and the locked state of the external component 2 and the lower component 3 is maintained. In this locked state, the coil spring 12 disposed in the lower space 52 of the lower component 3 biases the central circular plate 13*a* and supports the movable component 13 in its state in which it has been moved upwards, the lower surface of the engagement concave portion 13*d* comes into contact with the lower surface of the engagement convex portions 14*c* of the turnable components 14, and the movable component 13 supports the turnable components 14 in a turned state such that the hooks 14*a* of the turnable components 14 are moved outwardly, by means of which the locked state is maintained.

Because the sliding walls 22 of the external component 2 cover the lateral surface openings 30 of the lower component 3 at this time, a portion of the lateral external surfaces of the protruding components 4 are in contact with the sliding walls 22. By means of this, the protruding components 4, whose centers of rotation are the shafts 35, resist the elastic force of the coil springs 40 and are housed inside the lower component 3.

Because the permanent magnet 11, a magnetic body, is provided near the curved surface 6 that is the lower surface of the lower component 3 and forms the spherical surface of the toy 1 with the external component 2, if, as shown in FIGS. 6(*a*) and (*b*), a steel sheet 5, which is an external magnetic component provided in specific locations of the travel surface of the travel device mounted on a flat pedestal, etc., for example, exists near the permanent magnet 11 adhesively fixed to the movable component 13 disposed in the lower space 52 of the lower component 3, a magnetic force acts such that the permanent magnet 11 and the steel sheet 5 attract one another.

By means of such magnetic force, the permanent magnet 11 and the movable component 13 disposed in the lower space 52 of the lower component 3 of the toy 1 resist the elastic force of the coil spring 12 and move downwards integrally, causing the upper surface of the engagement concave portion 13*d* of the engagement portion 13*b* to come into contact with the upper surfaces of the engagement convex portions 14*c* of the turnable components 14 and press the upper surfaces of the engagement convex portions 14*c* downwards. By means of this, the turnable components 14 turn such that the hooks 14*a* move inwards with the shafts 32 as the centers of rotation, and the locked state of the external component 2 and the lower component 3 is released.

As a result, the elastic force of the coil spring 20 acts on the lower component 3 and the external component 2 through the elastic component support plate 36 of the lower component 3 and the cuboid 25 of the external component 2, and, if the external component 2 is in a fixed state, the lower component 3 slides downwards and rushes out, or, conversely, if the lower component 3 is in a fixed state, the external component 2 swiftly ascends upwards.

When the locked state of the external component 2 and the lower component 3 is released, the external component 2 and the lower component 3 instantly move in opposite directions and the lateral surface openings 30 open from the lower ends of the sliding walls 22. Consequently, the protruding components 4, which were housed in the lateral space 51 of the lower component 3 by means of the sliding walls 22 of the external component 2 when the toy 1 was in the first shape, turn from the sides upwards such that the lower ends thereof describe arcs, due to the locked state of the external component 2 and the lower component 3 having been released, and the protruding components 4 come to protrude from the lower component 3.

As a result, the elastic force of the torsion coil springs 40 is transmitted to the external component 2 through the protruding components 4, and force is applied in the direction in which the relative distance between the external component 2 and the lower component 3 increases. Consequently, the toy 1 is maintained in the second shape, in which the external component 2 and the lower component 3 are separated only to the prescribed distance. That is, when the locked state is released, the toy 1 instantly transforms from the first shape to the second shape by means of the elastic force of the coil spring 20 attached to the external component 2, and the toy 1 is maintained in the second shape, in which the protruding components 4, which are pivotally arranged in the lower component 3, protrude from the lower component 3.

Consequently, the toy 1 instantly transforms from the substantially spherical-shaped first shape shown in FIG. 1(*a*) to the character-shaped second shape shown in FIG. 1(*b*) by means of an external magnetic component coming close to the permanent magnetic body disposed in the lower portion of the lower component 3, and is then maintained in that state.

As shown in FIG. 6(*b*), protrusions 33 extend such that they protrude outwardly from the upper end of the anteroposterior surfaces of the lower component 3. By means of this, when the external component 2 and the lower component 3 move in vertical directions opposite one other, at the prescribed separation distance, the lower surfaces of the protrusions 33 engage with the internal walls corresponding to the anteroposterior area of the hole edge 27, and the separation distance is limited. As a result, the external component 2 and the lower component 3 do not detach from one another.

It is preferred that the toy 1 according to the present embodiment is enjoyed by rolling it and magnetically reacting the permanent magnet 11 in the toy 1 with steel sheets 5 disposed in specific locations in the travel surface on which the toy 1 is traveling. When and only when the rolling toy is positioned substantially directly over a steel sheet 5 disposed in the travel surface on which the toy 1 is traveling and the permanent magnet 11 is positioned in the lower portion of the toy 1 and comes close to the steel sheet 5, the permanent magnet 11 is attracted to the steel sheet 5 positioned thereunder. By means of this, the lower end of the lower component 3 is pulled towards the steel sheet 5 and the locked state of the external component 2 and the lower component 3 is released. As a result, the toy 1 stops rolling, and, as the lower component 3 is restricted from moving downwards due the travel surface and cannot rush out downwards, the external component 2 springs upwards (that is, the lower component 3, which rushed out from the hole 10 by means of being biased by the released elastic force, pushes the external component 2 in the location where the magnetic force acted), making it appear as if a doll has risen if a face, etc. is drawn on the external component 2.

In the present embodiment, after the external component 2 and the lower component 3 are swiftly separated by means of the coil spring 20 attached to the external component 2, the second shape is maintained by means of the protruding components 4, which are biased by means of the torsion coil springs 40. However, the second shape can also be maintained by means of supporting the coil spring 20 by means of the elastic component support plate 36, or, after the external component 2 and the lower component 3 have been separated to a prescribed distance by means of the coil spring 20, a plurality of elastic components can be utilized and separation movements performed in a plurality of stages to further separate them.

To restore the shape of the toy 1 from the second shape to the first shape, first, the user resists the elastic force of the torsion coil springs 40 and pushes the lower component 3 into the housing space 15 through the hole 10 of the external component 2. Then, the user resists the elastic force of the coil spring 20 that is applied while the user is pushing the lower component 3, and further pushes the lower component 3 into the housing space 15 of the external component 2. The lower ends of the locking components 21 then push the upper ends of the turnable components 14 of the lower component 3, the elastic force of the coil spring 12 disposed in the lower space 52 of the lower component 3 is resisted, the turnable components 14 turn such that the hooks 14*a* move inwards, and the locking components 21 move further downwards. By means of this, the locking components 21 of the external component 2 engage with the turnable components 14 of the lower component 3, and the external component 2 and the lower component 3 enter a locked state again. By means of such operation, the toy 1 is restored to the substantially spherical-shaped first shape, and the first shape of the toy 1 is maintained until a magnetic force acts again.

In the present embodiment, the locking components 21, whose upper ends, which are the cuboid 25 sides, are made fixed ends, and whose lower ends, which are the hook 21*a* sides, are made free ends, are formed of an elastic component that consists of an elastic-deformable plate spring, so when the lower ends of the locking components 21 come into contact with the upper ends of the turnable components 14, not only are the turnable components 14 pushed and turned by the locking components 21, but the lower ends of the locking components 21 themselves are elastic-deformed outwards, allowing the transition to the locked state to be performed smoothly.

In the toy 1 according to the present embodiment described above, when no external magnetic component, which magnetically reacts with the permanent magnet 11, a magnetic body, exists near the permanent magnet 11, the elastic force of the coil spring 20 is resisted, and the lower component 3 is retained inside the housing space 15 of the external component 2 by means of the locking components 21, the turnable components 14, and the movable component 13, which are a locking means, by means of which the rollable substantially spherical external shape of the toy 1 can be maintained. The toy 1 is constructed such that when a magnetic force has acted on the permanent magnet 11 from an external magnetic component, the movable component 13, which is a locking means, moves downwards in conjunction with the movement of the permanent magnet 11 and the turnable components 14 turn, by means of which the locked state is released, and the lower component 3 is biased by means of the released elastic force and can rush out downwards from the hole 10.

By means of this, when in the substantially spherical first shape, the toy 1 rolls and moves on the travel surface in response to a rolling operation from the user, in a state in which the substantially spherical shape is maintained, and can transform to the second shape at locations where the steel sheets 5, external magnetic components, are disposed. As a result, the user can enjoy playing games by rolling the toy 1 in various locations and transforming the toy 1 when the permanent magnet 11 is brought near an accessible external magnetic component.

By means of achieving a dynamic transformation with larger movement particularly in the vertical direction in a rollable magnetic-force-expansion-style toys, the commercial value of the toy is increased, fresh wonderment and intellectual excitement is imparted to the user, and a toy can be constructed with a suppressed number of parts that doesn't require a complicated transformation, thus making it possible to reduce manufacturing costs and the number of manufacturing processes.

By means of making the magnetic body a permanent magnet 11, the properties of the magnetic body as a magnet can be retained over a relatively long time period, and by means of making the external magnetic components steel sheets 5, the user can readily play with the toy 1 in various locations.

The toy 1 according to the present embodiment has a structure such that the protruding components 4 are provided in the lower component 3, and when the toy 1 transforms, an operation that protrudes the protruding components 4 laterally in conjunction with the rushing out of the lower component 3 can be performed, so the aspect of the transformation can be expanded to contain not only movement in the vertical direction, but in the lateral direction as well. In the present embodiment, a structure is employed in which the protruding components 4 are pivotally arranged inside the lower component 3 and protrude laterally by means of a turning movement, but the protruding components 4 can also protrude laterally by means of a rectilinear movement, and can also protrude not only horizontally, but in the anteroposterior direction as well.

The toy 1 has a structure such that it can be restored from the character-shaped second shape to the substantially spherical-shaped first shape, and when the toy 1 has been restored to the substantially spherical first shape by housing the lower component 3 inside the housing space 15 of the external component 2, a locked state is achieved by means of a locking means of the external component 2 and the lower component 3, and the spherical shape is maintained again. Consequently, even after the toy 1 has transformed from the first shape to the second shape by means of the action of a magnetic force, the user can restore the toy 1 to a rollable substantially spherical shape and use it again, so it can be repeatedly played with.

Although games with the toy 1 can be enjoyed by utilizing accessible external magnetic components, a preferred play method will now be described as a play example for further enjoyment. A travel device 60 provided with a travel surface 61*a* as shown in FIG. 7 is provided for the toy 1 to roll on. FIG. 7(*a*) is a plan view of the travel device 60, and FIG. 7(*b*) is a front elevation view of the travel device 60. The travel surface 61*a* of the travel device 60 has an annular shape and rotates with a central axis as the center of rotation, and steel sheets 5 are disposed in a plurality of specific locations under the surface of the travel surface 61*a*. When the toy 1 rolls and moves in the first shape, the travel surface 61*a* slowly rotates. Then, when the toy 1 passes directly over a steel sheet 5 disposed under the surface of the travel surface 61*a*, the permanent magnet 11 disposed in the curved surface 6 of the lower component 3 of the rolling toy 1 becomes positioned at the lower surface and the steel sheet 5 and the permanent magnet 11 come close to one another, causing a magnetic force to act on the permanent magnet 11, whereupon the toy 1 transforms to the second shape.

The travel device 60 is provided with a hollow, cylindrical chassis consisting of plastic, etc., a lever 63, and a mounting pedestal 64. The chassis is provided with a rotatable rotating plate 61 with a central axis as the axis of rotation, an external wall 62 provided around the periphery of the rotating plate 61, and a drive mechanism that rotates the rotating plate 61. The travel device 60 is constructed such that, when the lever 63 is operated, the rotating plate 61 rotates by means of the drive mechanism built into the chassis. The annular upper surface of the rotating plate 61 is the travel surface 61*a*.

The lever 63 is hollow and is pivotally arranged on the chassis. An entry hole 63*a*, which is a circular opening, is formed on the upper surface thereof, an exit hole 63*b* is formed on the lateral surface thereof beside the travel surface 61*a*, and the interior thereof is provided with a retaining means. The entry hole 63*a* and the exit hole 63*b* are formed to be openings with a diameter larger than the toy 1 in the first shape. The retaining means consists of a fan-shaped turning component and gears, etc. not shown in the drawings, and is constructed such that, when the lever 63 is tilted outwardly, the fan-shaped rotating component tilts in a direction opposite to that of the lever 63.

The drive mechanism is constructed of a cam 65 that is fixed to the lower end of the lever 63 and is inserted from a lateral surface opening in the chassis, a driven portion 66 that is pivotally arranged on the lower surface of the chassis such that it can rotate in conjunction with the movement of the cam 65, a rack 67 disposed such that it can slide on a pedestal not shown in the drawings inside the chassis in conjunction with the rotation of the driven portion 66, a first gear 68 pivotally arranged such that it can rotate in conjunction with the sliding movement of the rack 67, and a second gear 69 fixed to the central axis of the rotating plate 61 such that it can rotate in conjunction with the rotation of the first gear 68.

Consequently, when the lever 63 is operated, the rotating plate 61 rotates by means of the drive mechanism. By means of employing a ratchet mechanism to limit the direction of movement of the first gear 68 and the rack 67 to one direction, the rotating plate 61 can be rotated for a short period of time through inertia in conjunction with the operation of the lever 63. A motor that operates in conjunction with the operation of the lever 63 can also be made the power source of the drive mechanism.

The rotating plate 61 rotates with an axis shared by the second gear 69 as the center of rotation, and is provided with an annular travel surface 61*a* and a substantially hollow hemispherical hemisphere 61*b* in the center thereof. The rotating plate 61 is constructed such that the upper end of the axis of the second gear 69 is fixed to the hemisphere 61*b*, and can stably rotate with the upper ends of three reinforcing shafts fixed thereto. The lower ends of the reinforcing shafts are fixed to a circular plate that is fixed to an axis, with the axis of the second gear 69 as the center. Steel sheets 5, external magnetic components, are fixed under the surface of designs 61*c* drawn on the travel surface 61*a* of the rotating plate 61.

The procedure of a game using the travel device 60 will now be described.

First, the user inserts the toy 1 in the first shape, which is set on the mounting pedestal 64, into the entry hole 63*a* of the travel device 60. After the toy 1 is inserted, it drops into the lever 63 and is retained by means of the retaining means inside the lever 63 near the exit hole 63*b*. Next, the user tilts the lever 63 outwardly, and the fan-shaped rotating component, which is the retaining means, tilts such that the opening of the exit hole 63*b* enlarges, and the toy 1 is discharged from the exit hole 63*b*. The retaining means forms a gentle slope so that the toy 1 can be discharged from the exit hole 63*b*, so when the lever 63 is operated, the toy 1 is naturally guided onto the travel surface 61*a*.

When the lever 63 is operated, the drive mechanism operates and the travel surface 61*a* rotates. Control devices can also be provided to simultaneously flash LED lights, etc., and play music from speakers. The toy 1 guided onto the travel surface 61*a* rolls around on the travel surface 61*a*, changing directions when it impacts the external wall 62, which is the periphery of the travel surface 61*a*, and the hemisphere 61*b* disposed in the center.

When the permanent magnet 11 disposed in the curved surface 6, which is the lower surface of the toy 1, comes close to one of the designs 61*c*, which are the specific locations in which the steel sheets 5 of the travel surface 61 are disposed, and a magnetic force acts between the permanent magnet 11 and the steel sheet 5, the toy 1 stops rolling at the location where the magnetic force acted and instantly transforms to the second shape. In the present embodiment, a plurality of different character faces are drawn as the designs 61*c* in specific locations on the travel surface 61*a* of the travel device 61, on the reverse sides of which steel sheets 5 of substantially the same size as the character faces are disposed.

A plurality of users sequentially insert the toy 1 onto the travel surface 61*a*, and the users receive character cards that match the character designs 61*c* in the locations on which the toy 1 transformed. If the toy 1 transforms again on a character design 61*c* corresponding to a character card that has already been distributed to a user, the user cannot receive that character card. The game is finished when there are no cards left, and the user who has the most cards wins. By establishing such rules beforehand, the travel device 60 and the toy 1 can be used as a game that a plurality of users can enjoy.

If this travel device 60 is used, the toy 1 rolls on the travel surface 61*a* and the travel surface 61*a* rotates, so the user cannot predict on what character design 61*c* the toy 1 will transform. When the toy 1 travels onto the location of a steel sheet 5, which are disposed in a plurality of locations on the travel surface 61*a*, when the curved surface 6 of the lower component 3 comes into contact with the travel surface 61*a*, the permanent magnet 11 of the toy 1 is pulled towards the steel sheet 5, an external magnetic component, and the toy 1 transforms to the second shape, making it appear as if a character has risen. Consequently, because the toy 1 can suddenly rise at any of the plurality of specific locations, the user's enjoyment can be enhanced more than if the travel surface 61*a* did not rotate.

The present invention is not limited to the embodiment described above, and can be freely modified or improved without departing from the scope thereof.

For example, in the embodiment described above, an example was provided in which a spherical shape was employed as the first shape of the toy. However, other rollable shapes can be employed as the first shape of the toy, by constructing it such that the shell has a rotationally symmetrical shape, such as a cylinder or a rugby ball. The second shape of the toy is also not particularly limited, and a variety of shapes can be employed. Also, in the embodiment described above, an example was provided in which coil springs and torsion coil springs were employed as elastic components. However, other elastic components, such as rubber, plate springs, etc., can be employed.

In the embodiment described above, an example was provided in which a magnetic body inside the toy is attracted and a locking means is provided such that the locked state of the toy can be released. However, the aspect of the movement of the magnetic body and the mechanical aspects of the components that constitute the locking means are not limited thereto. A structure in which the magnetic body inside the toy moves inwardly inside the toy 1 by means of making the magnetic polarity of the external magnetic component and the magnetic polarity of the magnetic body inside the toy repel one another, etc. to achieve the transformation can also be employed.

In the embodiment described above, an example was provided in which the external magnetic components were made steel sheets and the magnetic body inside the toy was made a permanent magnet. However, the external magnetic components can also be made permanent magnets and the magnetic body inside the toy made a steel sheet. That is, the transformation can be achieved by providing each with components such that a magnetic force will act therebetween.

In the embodiment described above, the structure of the lower component, which is the torso of the character, can be transformed in accordance with the character. For example, if the character is an animal, the turning mechanism of the protruding components 4 can be utilized to make a tail rush out the back when the lower component 3 rushes out. Horns, for example, can be added to the upper component of the external component 2, which is the head of the animal character, and folded in such that a rotationally symmetrical shape is formed when the lower component 3 is housed inside the external component 2, and a structure added such that the horns rush upwards in conjunction with the locking mechanism.

The invention claimed is:

1. A toy that rolls on a travel surface when in a substantially spherical first shape in response to a rolling operation caused by a user, and transforms to a second shape at a location where an external magnetic component is disposed, said toy comprising:

an external component having a substantially spherical shape, an open hole at a lower portion of said spherical shape and a housing space formed within said spherical shape, said spherically shaped component being configured to form a head of a toy character of the second shape;

a lower component movably disposed in said housing space when the toy is in said first shape so that a lower surface of the lower component aligns with the spherical lower surface of said external component to constitute said substantially spherical shape, to allow the external component with the lower component in the first shape to roll on a travel surface, and configured to thrust out from the bottom of said external component through said open hole when the toy is caused to transform to said second shape, said lower component being configured to have a width smaller than the diameter of said spherical shape and to form a trunk of the toy character of the second shape;

a locking means;

a magnetic body disposed inside the bottom of said lower component; and an elastic component biased to eject the lower component from the bottom of the spherically shaped external component with the magnetic body retained in the bottom of the lower component;

wherein, in the absence of any external magnetic component said lower component is retained inside said housing space against a bias of the elastic force of said elastic component by means of said locking means, so that said toy can roll on a travel surface in response to a rolling operation caused by a user, maintaining said substantially spherical shape; and wherein, when said toy rolls by a rolling operation by a user and reaches a location where a magnetic force has acted between said rolling toy and the external magnetic component, the magnetic body moved by the magnetic force causes release of said locking means and said lower component thrusts out towards the external magnetic component from the bottom of said external component through said open hole by means of said released elastic force, and pushes up said external component on the thrusting lower component by means of said released elastic force at the location where the magnetic force has acted to the magnetic body at the bottom of the lower component, whereby the toy character suddenly shows the hidden trunk and rises with the head up on the thrusting-out trunk.

2. The toy according to claim 1, wherein said magnetic body is a permanent magnet, and said external magnetic components are steel sheets.

3. The toy according to claim 1, wherein said housing space includes an elongated space confined with inside walls so that the trunk of the toy character is slidably hidden in the elongated space of the head, wherein said lower component is configured in an elongated shape to have side walls corresponding to said inside walls of said elongated space and comprises:

a pair of openings disposed at the side walls at flanks of said trunk of the toy character;

protruding components configured in shapes indicative of arms of the toy character and disposed movably at said openings; and a further elastic component that provides an elastic force biasing each of said protruding components when the protruding components are held within the openings, wherein said inside walls of said elongated space in the housing space of said external component confine movements of each of the protruding components against the bias of the elastic force of the further elastic component while said lower component is held inside of said elongated space of the housing space at said first shape of the toy, wherein when a magnetic force has acted between the external magnetic component and said magnetic body, at the same time as said lower component thrusts outside towards the external magnetic component from said housing space, each of said protruding components rushes out from said opening at the flank of said lower component by means of the released elastic force of the further elastic component, such that, when the rolling toy reaches the location where the magnetic force acts, the toy character suddenly shows the hidden trunk and arms and rises with the head up on the thrusting-out trunk.

4. The toy according to claim 1, wherein said magnetic body is movably disposed at a bottom portion inside the lower component, wherein said locking means comprises:

a movable component disposed at the bottom portion inside the lower component and configured to move vertically integrally with said magnetic body;

turnable components arranged on said movable component and configured to pivotally turn in conjunction with the vertical movement of said movable component; and a locking component having a top portion disposed inside of said external component and lower ends disposed correspondingly to said turnable components such that the lower ends engage with said turnable components when said lower component is held inside said housing space at said first shape of the toy and such that the lower ends disengage from said turnable components in response to a movement of said magnetic body when a magnetic force has acted between the external magnetic component and the magnetic body at said second shape of the toy.

5. The toy according to claim 3, wherein said magnetic body is movably disposed at a bottom portion inside the lower component, wherein said locking means comprises:

a movable component disposed at the bottom portion inside the lower component and configured to move vertically integrally with said magnetic body;

turnable components arranged on said movable component and configured to pivotally turn in conjunction with the vertical movement of said movable component; and a locking component having a top portion disposed inside of said external component and lower ends disposed correspondingly to said turnable components such that the lower ends engage with said turnable components when said lower component is held inside said housing space at said first shape of the toy and such that the lower ends disengage from said turnable components in response to a movement of said magnetic body when a magnetic force has acted between the external magnetic component and the magnetic body at said second shape of the toy.

6. The toy according to claim 1, wherein said toy is constructed such that it can be restored from said second shape to said first shape, and when it has been restored from said second shape to said first shape, a locked state is achieved by means of said locking means and said first shape is maintained again.

7. A transformable toy comprising:

an upper component formed in a substantially spherical shell, provided with an open hole at a bottom portion of the shell, and a housing space formed inside said shell, said spherical shell being configured to form a head of a toy character of the second shape;

a lower component movably disposed inside said housing space at a first form of the toy and configured to thrust out from the bottom portion of the shell through said open hole at a second form of the toy, in which a lower surface of the lower component aligns with a surface of the bottom portion of said upper component to form a substantially spherical shape of the toy to allow the upper component with the lower component at the first form of the toy to roll on a travel surface, said lower component being configured to have a width smaller than the diameter of said spherical shape and to form a trunk of the toy character;

a locking means disposed inside the said housing space;

a magnetic body movably disposed inside the bottom of said lower component at a bottom portion of the lower component in the vicinity of said lower surface; and an elastic component disposed inside said lower component such that an elastic force of the elastic component causes said lower component to thrust out from the bottom of the spherically shaped upper component with said magnetic body retained in the bottom of the lower component when the elastic force is released, wherein in an environment without any external magnetic component near said magnetic body, said lower component is retained inside said housing space against the bias of the elastic force of the elastic component by means of said locking means to allow the toy of the first form to maintain a rollable external shape configured by the upper component and the lower component, wherein, on rolling of the toy caused by a playing user, said toy stops rolling at a location where a magnetic force has acted between said rolling toy and an external magnetic component, the magnetic body moved by the magnetic force causes release of said locking means, and the released elastic force of said elastic component causes the lower component with the magnetic body retained inside the lower component to thrust out towards the external magnetic component from said bottom of said shell through said open hole to push up said upper component is pushed up by the thrusting movement of the lower component, while the upper component keeps the substantially spherical shape at the location where the magnetic force acts, whereby the toy character suddenly shows the hidden trunk and rises with the head up on the thrusting-out trunk.

* * * * *